US006053768A

United States Patent [19]

Chiang

[11] Patent Number: 6,053,768

[45] Date of Patent: Apr. 25, 2000

[54] ELECTRICAL CONNECTOR WITH BOARD LOCKING MEANS

[75] Inventor: Cheng-Chin Chiang, Yung-Ho, Taiwan

[73] Assignee: Hon Hai Precision Ind. Co., Ltd., Taipei Hsien, Taiwan

[21] Appl. No.: 08/990,559

[22] Filed: Dec. 15, 1997

[30] Foreign Application Priority Data

Dec. 14, 1996 [TW] Taiwan ..... 85219494

[51] Int. Cl.[7] ..... H01R 13/60

[52] U.S. Cl. ..... 439/571

[58] Field of Search ..... 439/571, 567, 439/569, 570, 607, 626, 870, 871, 872, 248, 374, 712, 533.1, 536, 736, 82, 83

[56] References Cited

U.S. PATENT DOCUMENTS 4,943,244 7/1990 Teck et al. ..... 439/571

5,163,851 11/1992 Hart et al. ..... 439/567

5,238,413 8/1993 McCaffrey et al. ..... 439/571

*Primary Examiner*—Eugene Eickholt

[57] ABSTRACT

An electrical connector for electrically connecting an exterior mating connector to a circuit board, mainly comprises an insulative housing and a board locking means. The insulative housing includes a plurality of receiving portions each which consist of a slot and a cavity. The board locking means fabricated from a metallic strip/wire by bending processes, is configured with a pair of spaced spring arms each which include a bended first latching portion for latching with a corresponding through hole formed in the circuit board, and a bended second latching portion having a free end to be movably and relaesably retained within the slot of the housing. The board locking means is capable of being easily fabricated and providing the circuit board/the housing with a harmless and sufficient retention.

11 Claims, 4 Drawing Sheets

ELECTRICAL CONNECTOR WITH BOARD LOCKING MEANS

BACKGROUND OF THE INVENTION

1. Field of the Invention

The present invention relates to an electrical connector for electrically connecting an exterior mating connector to a circuit board, and particularly to an electrical connector with elastic board locking means for providing the circuit board/an insulative housing of the electrical connector with a sufficient and harmless retention.

2. The Prior Art

As known, two types conventional board locking means based on different manufacturing methods thereof are presently proposed for retaining electrical connectors on a circuit board of a computer system. One type as a numeral (1) shown in FIG. 1 generally including an inwardly threaded sleeve (11) for retention with an insulative housing of the electrical connector (not shown) and a plurality of claw (12) for retention with the circuit board (not shown), is fabricated by different manufacturing steps including at least a lathe process, a drilling process and a milling process. However, such complicated manufacturing processes must take higher labor costs and spend longer time. Another type as shown in FIG. 2 is fabricated from a piece metal sheet by stamping process. The stamped type board locking means (2) mostly includes a pair of like-blade elastic claws (21) which easily knife an edge of a border of a through hole (not shown) formed in the circuit board (not shown) when the claws (21) of the board locking means (2) are inserted into the through hole and elastically compressed by the border of the through hole. The above-mentioned conventional board locking means are disclosed in Japan Utility Patent Nos. 4-38671, 4-38672, 4-55775, 61-99971, and U.S. Pat. Nos. 4,842,552, 5,004,430, 5,085,589 and 5,044,988, and Taiwan Patent Application Nos. 78,209,509 and 81,201,057.

Accordingly, to resolve the above disadvantages, an object of the present invention is to provide an electrical connector with board locking means which forms thereon and a bended first latching portion for providing to the circuit board with a harmless and sufficient retention by means of bending process.

Another object of the present invention is to provide an electrical connector with board locking means which forms thereon a bended second latching portion for providing an insulative housing of the electrical connector with a harmless and sufficient retention by means of bending process.

Another object of the present invention is to provide an electrical connector with board locking means of which construction is easily fabricated by bending processes.

SUMMARY OF THE INVENTION

According to an aspect of the present invention, an electrical connector for electrically connecting an exterior mating connector to a circuit board, mainly comprises an insulative housing and a board locking means. The insulative housing defines a pair of spaced receiving portions each which consist of a first shoulder, a second shoulder, a slot and a cavity. The board locking means fabricated from a metallic strip/wire by bending processes, is configured with a pair of spaced spring arms each which include a bended first latching portion having a flat engaging section and an inclined acting section for latching with a corresponding through hole formed in the circuit board, and a bended second latching portion having a free end and a buffer region whereby the free end of the second latching portion is able to be movably and relaesably received within the slot of the housing to latch with the second shoulder. At the same time, the first latching portion is able to latch with the first shoulder for avoiding buckling status happened in the spring arms. Therefore, by means of bending processes, the board locking means is easily fabricated and capable of providing the circuit board/the housing with a harmless and sufficient retention.

DETAILED DESCRIPTION OF THE PREFERRED EMBODIMENTS

Figure 1:
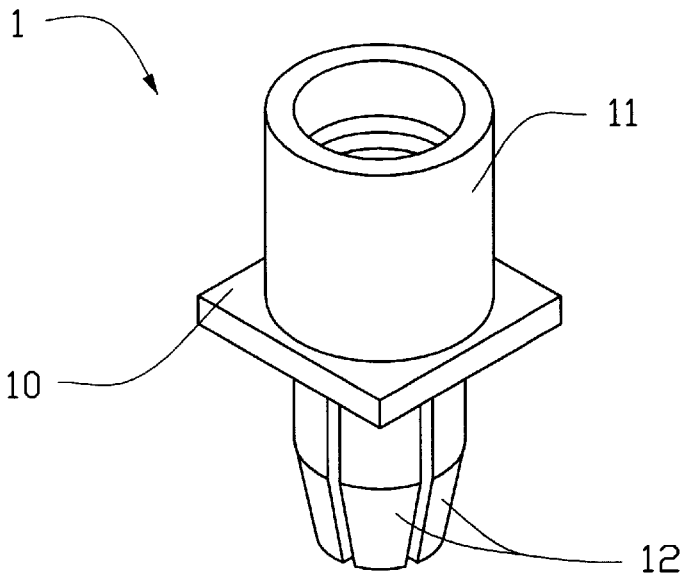
(PRIOR ART) FIG.1
FIG. 1 is a perspective view of a conventional board locking means.
Figure 2:
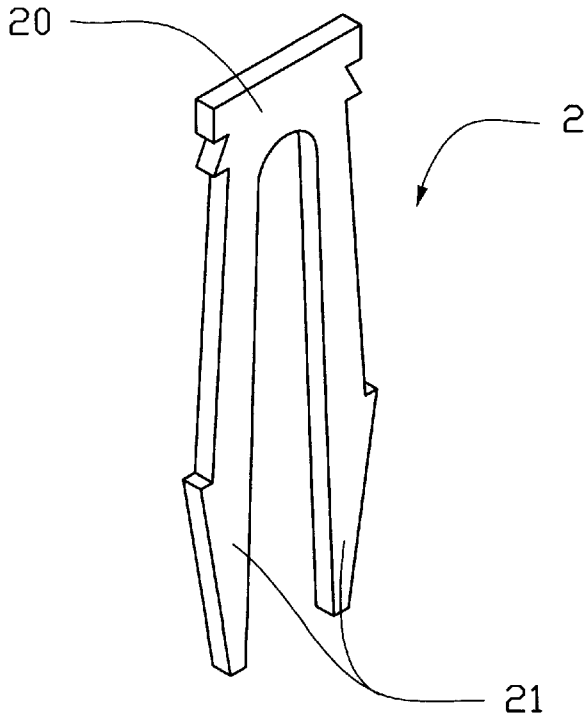
(PRIOR ART) FIG.2
FIG. 2 is a perspective view of another conventional board locking means.
Figure 3:
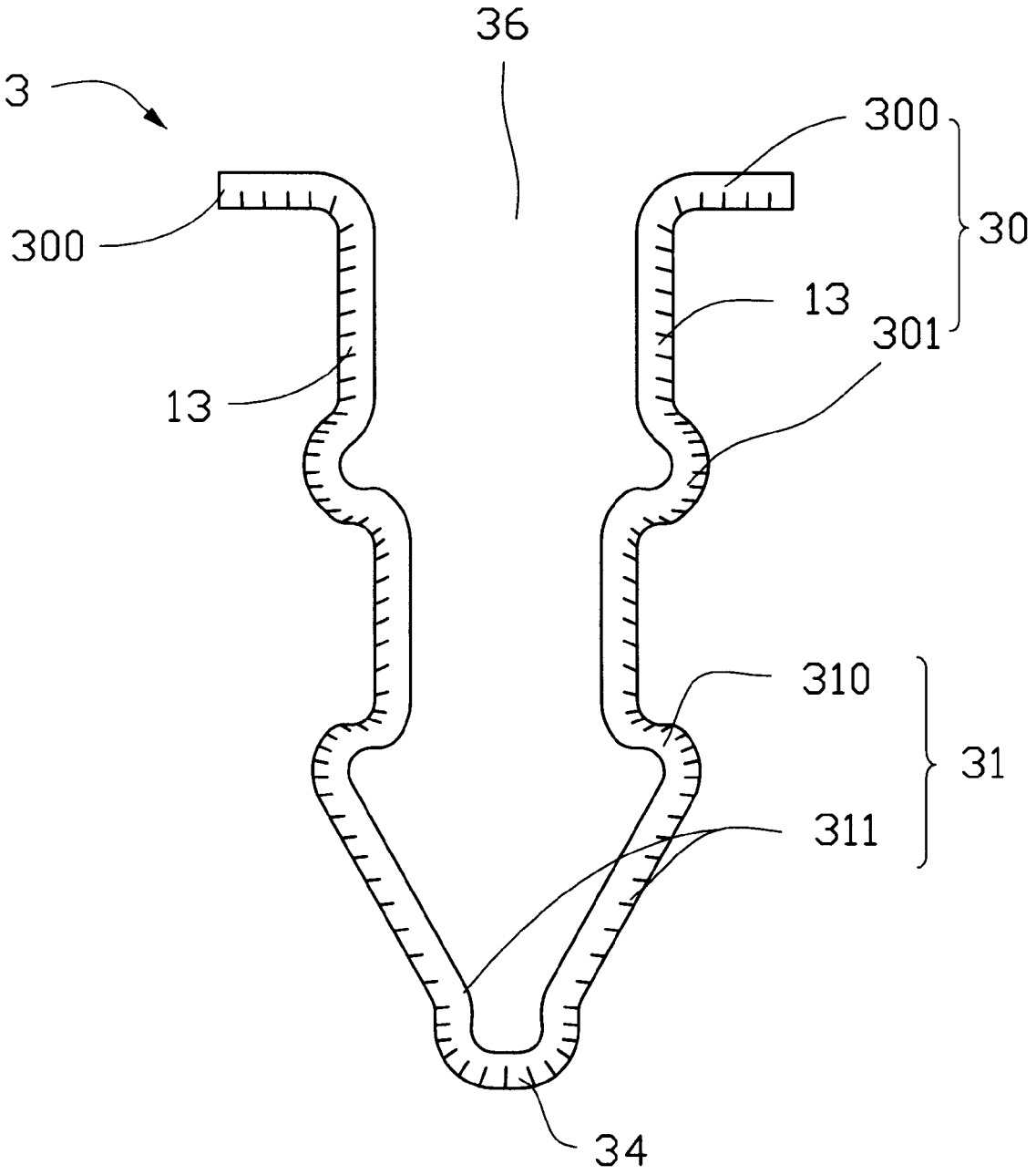
FIG. 3 is a front perspective view of a board locking means according to the present invention.
Figure 4A:
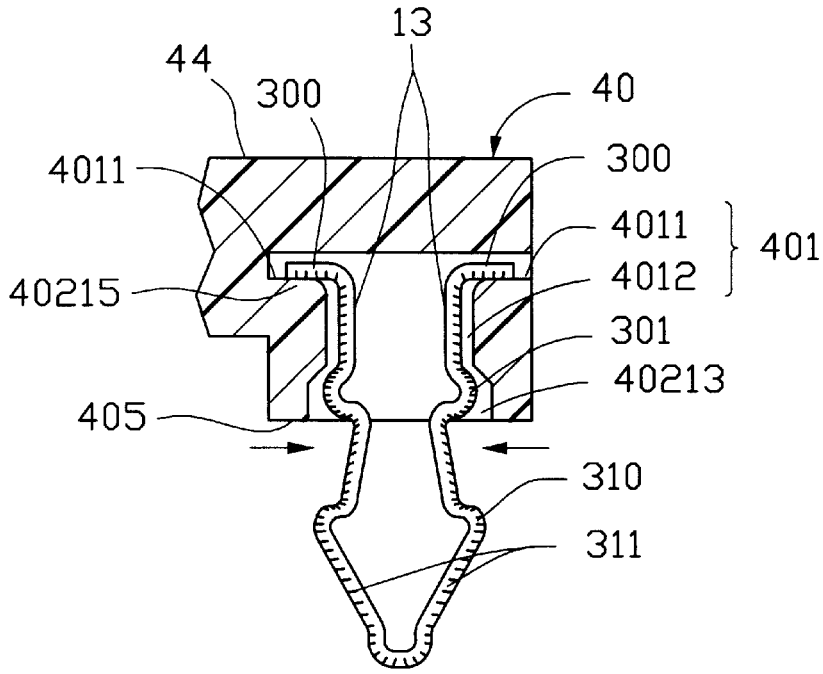
FIGS. 4(A)–4(B) are partially cross-sectional perspective view of the board locking means according to the present invention showing the board locking means is step by step assembled within the electrical connector.
Figure 4B:
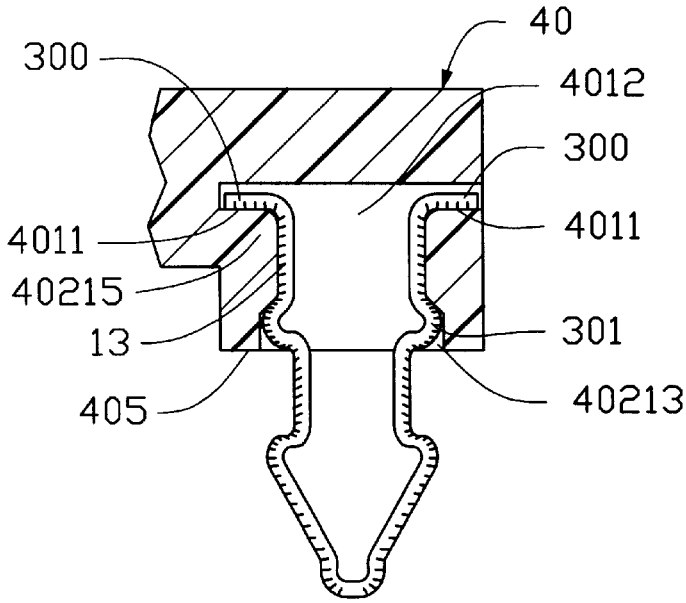
Figure 5A:
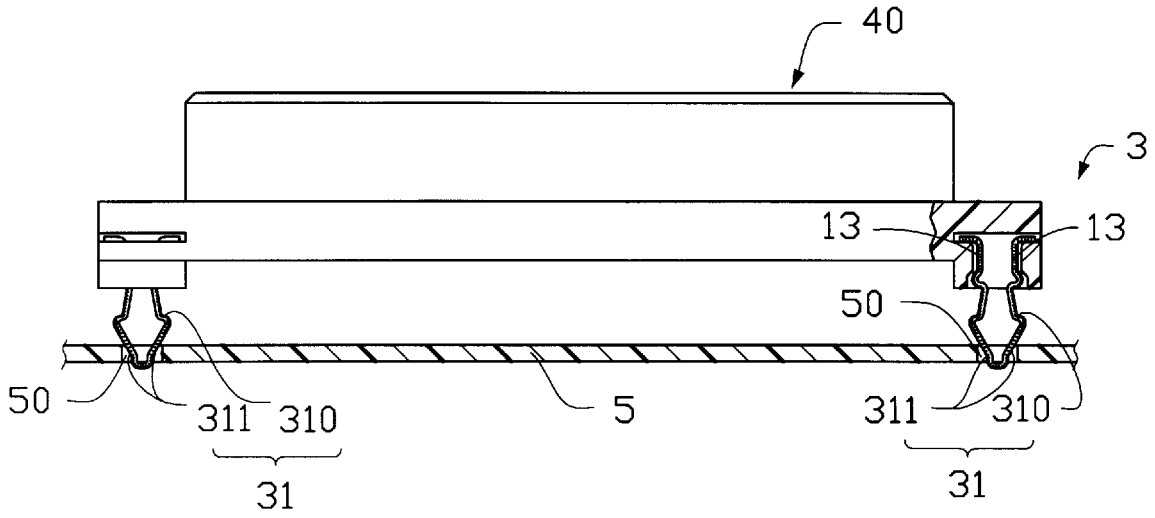
FIGS. 5(A)–5(B) are partially cross-sectional perspective view of the board locking means according to the present invention showing the board locking means are step by step inserted within the through holes of the circuit board.
Figure 5B:
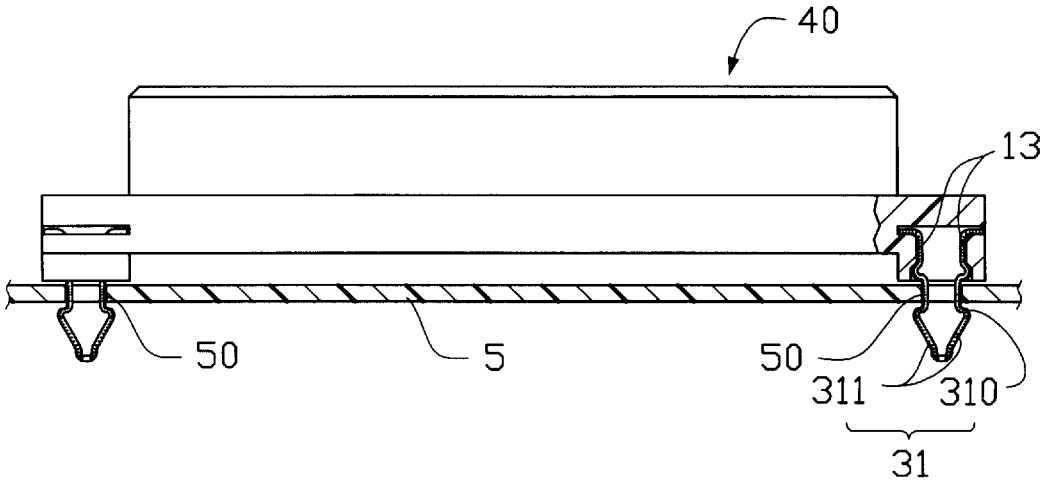

References will now be made in detail with regard to the preferred embodiment of the present invention. A board locking means (3) for mounting an electrical connector (40) onto a circuit board (5) is shown in FIGS. 3, 5(A) & 5(B) wherein the electrical connector (40) for electrically connecting an exterior mating connector (not shown) to the circuit board (5) includes an insulative housing (44) as shown in FIGS. 4(A) & 4(B) which forms a pair of receiving portions (401) on a bottom surface (405) thereof in opposite positions. Each receiving portion (401) consists of a slot (4011) and a cavity (4012) located below the slot (4011) wherein the width of the cavity (4012) is less than that of the slot (4011). On each of opposite walls in the cavity (4012), a first shoulder (40213) is formed close to the bottom surface (405), and a second shoulder (40215) is located vertically opposite to each first shoulder (40213).

The board locking means (3) as shown in FIG. 3, is fabricated from a metallic strip/wire with the same width. The metallic strip/wire is pre-cut in a specific length by means of cutting process. Then, the metallic strip/wire merely utilizes successively bending processes to construct the whole board locking means (3). As the result, the board locking means (3) forms a bended interconnecting portion (34) located at an end thereof, and an opening portion (36) is located at an opposite end, and a pair of spaced and opposed spring arms (13) located between the interconnecting portion (34) and opening portion (36) wherein the bended interconnecting portion (34) is respectively and integrally connected with an end (not shown) of each of spring arms (13) to configure a close end. A space (not labeled) is formed between the spring arms (13) and vertically communicates with the outside through the opening portion (36).

Each spring arm (13) includes a bended first latching portion (31) for latching with a through hole (50) (as shown in FIG. 5(A)) formed in the circuit board (5), and a bended second latching portion (30) for latching with the receiving portion (401) of the insulative housing (41) as shown in FIGS. 4(A)–4(B) wherein the first latching portion (31) and second latching portion (30) are angularly bended with respect to the bottom surface (405) of the housing (44). The bended first latching portion (31) further consists of a horizontal flat engaging section (310) and an inclined acting section (311) angularity bended with regard to the horizontal flat engaging section (310) wherein the inclined acting section (311) is able to be acted by a reactive force from a border of the through hole (50) to elastically compress the spring arms (13) when the board locking means (3) initially contacts with the border of the through hole (50) on a top surface (not shown) of the circuit board (5) as shown in FIG. 5(A), and the horizontal engaging section (310) is adapted to be latchingly engaged with the border of the through hole (50) on the bottom surface (not shown) of the circuit board (5) when the board locking means (3) is completely inserted into the through hole (50) of the circuit board (5) as shown in FIG. 5(B).

The bended second latching portion (30) includes a free end (300) and a bended buffer region (301) cooperating with the free end (300) to oppositely latch with a corresponding wall formed in the receiving portion (401) of the housing (44) (the detail will be described later). The free end (300) is perpendicularly bended outward with respect to the corresponding spring arm (13) to extend apart from that of the other spring arm (13) and to be adjacent to the opening portion (36). The bended buffer region (301) is located below the free end (300).

In assembly, as shown in FIGS. 4(A)–4(B), by means of elastically compressing the pair of spring arms (13) of the board locking means (3) by manual, the free ends (300) of the spring arms (13) are upward inserted into the cavity (4012) from the bottom surface (405) of the housing (44) until the free ends (300) reaches the slot (4011) of the receiving portion (401) of the housing (44). Then, the compressed spring arms (301, 302) are released to movably and releasably enter within the slot (4011) to latch with the second shoulder (40215). At the same time, the bended buffer region (301) latches with the first shoulder (40213) in an opposite direction with regard to the latching of the free end (300) to avoid buckling status happened in the spring arms (13) shown in FIGS. 5(A)–5(B). Similarly, by means of the elasticity of the spring arms (13), the board locking means (5) is capable of being reversedly dismantled from the housing (44) or from the circuit board (5).

It is noted that the board locking means (3) is capable of providing a sufficient and harmless retention with regard to the housing (44)/the circuit board (5) by means of the first and second latching portions (30, 31) thereof all which are fabricated by bending process.

While the present invention has been described with reference to a specific embodiment, the description is illustrative of the invention and is not to be construed as limiting the invention in any way. Various modifications to the present invention can be made to the preferred embodiment by those skilled in the art without departing from the true spirit and scope of the invention as defined by the appended claims.

Therefore, person of ordinary skill in this field are to understand that all such equivalent structures are to be included within the scope of the following claims.

I claim:

1. An electrical connector for electrically connecting an exterior mating connector to a circuit board, comprising:

an insulative housing having at least a receiving portion with at least a first shoulder and a second shoulder formed therein; and a board locking means consisting of at least a pair of spring arms which are spaced apart from each other at a free end thereof and integrally connected with each other at an opposed end thereof so that the free ends of the spring arms are releasably retained within the receiving portion of the insulative housing, and the opposed ends of spring arms are releasably retained within a through hole formed in the circuit board wherein each spring arm further includes a bended buffer region which latches with the first shoulder in an opposite direction with regard to the free end latching with the second shoulder for avoiding a buckling status in the spring arms.

2. The electrical connector as described in claim 1, wherein the receiving portion is defined with a cavity and a slot wherein the width of the cavity is less than that of the slot.

3. The electrical connector as described in claim 2, wherein the free ends of the spring arm are movably received within the slot.

4. The electrical connector as described in claim 1, wherein a space is formed between said spring arms and vertically communicates with the outside.

5. An electrical connector for electrically connecting an exterior mating connector to a circuit board comprises:

an insulative housing forming at least a receiving portion on a bottom surface thereof; and a board locking means including a pair of spring arms each which form thereon at least a latching portion angularly bended with regard to the bottom surface of the housing to latch with either a through hole formed in the circuit board or the receiving portion of the insulative housing wherein the bended latching portion of each spring arm latching with the through hole of the circuit board, consists of an horizontal flat engaging section capable of latchingly engaging with a border of the through hole on a bottom surface of the circuit board, and an inclined acting section capable of being acted by a reactive force from the border of the through hole.

6. The electrical connector as described in claim 5, wherein the receiving portion of the housing includes at least a first shoulder and a slot located above the first shoulder.

7. The electrical connector as described in claim 6, wherein the bended latching portion of each spring arm latching with the receiving portion of the insulative housing includes a free end which is received within the slot of the receiving portion to latch with the first shoulder.

8. The electrical connector as described in claim 6, wherein the receiving portion of the housing includes at least a second shoulder adjacent to the bottom surface of the housing.

9. The electrical connector as described in claim 8, wherein the bended latching portion of each spring arm latching with the receiving portion of the insulative housing further forms thereon a bended buffer region which latches with the second shoulder of the receiving portion for avoiding buckling status when the board locking means is inserted into the through hole of the circuit board.

10. A method of arranging a board locking means within an electrical connector for use with a circuit board wherein the locking means includes at least a pair of spring arms each including a free end, and the electrical connector includes an insulative housing which defines a slot, a cavity and a first and second shoulders adjacent to the cavity, on a bottom surface thereof facing the circuit board, comprising the steps of:

by means of elastically compressing the pair of spring arms by manual, the free ends of the spring arms being upward inserted into the cavity from the bottom surface of the housing until the free ends reaches the slots of the housing; and then, the compressed spring arms being released to movably and releasably retained within the slot wherein each spring arm further includes a bended buffer region which latches with the first shoulder in an opposite direction with regard to the free end latching with the second shoulder for avoiding a buckling status in the spring arms.

11. The method as described in claim 10, wherein by means of the elasticity of the spring arms, the board locking means is capable of being reversedly dismantled from the housing.

* * * * *